US008313132B2

(12) United States Patent
Kuzma et al.

(10) Patent No.: US 8,313,132 B2
(45) Date of Patent: Nov. 20, 2012

(54) CONTAINER CARRIER SYSTEM

(75) Inventors: Gene J. Kuzma, Powell, OH (US); Jonathan Davia, Dublin, OH (US)

(73) Assignee: GK Packaging, Inc, Plain City, OH (US)

( * ) Notice: Subject to any disclaimer, the term of this patent is extended or adjusted under 35 U.S.C. 154(b) by 442 days.

(21) Appl. No.: 12/725,008

(22) Filed: Mar. 16, 2010

(65) Prior Publication Data

US 2011/0226791 A1 Sep. 22, 2011

(51) Int. Cl.
*A45F 5/00* (2006.01)

(52) U.S. Cl. ..... 294/159; 294/87.2; 206/151

(58) Field of Classification Search ..... 294/137, 294/159, 165, 167, 27.1, 31.2, 87.2; 220/751, 220/756, 758; 206/152, 151, 153, 428
See application file for complete search history.

(56) References Cited

U.S. PATENT DOCUMENTS 3,258,288 A * 6/1966 Courter ..... 294/87.2
4,564,106 A * 1/1986 Shilcock ..... 206/165
5,480,204 A * 1/1996 Erickson ..... 294/87.2
6,334,531 B1 * 1/2002 Valkovich ..... 206/163
7,108,128 B2 * 9/2006 Borg ..... 206/150

* cited by examiner

*Primary Examiner* — Dean Kramer
*Assistant Examiner* — Stephen Vu
(74) *Attorney, Agent, or Firm* — Michael J. Gallagher; David J. Dawsey; Gallagher & Dawsey Co., LPA

(57) ABSTRACT

A container carrier system for securing and carrying at least two containers is provided. The container carrier system generally includes a handle and at least two retainer rings. The handle has a carrying portion and at least two attachment portions. A single retainer ring is secured to a single container, and each retainer ring includes at least one handle receiver for receiving and retaining a single attachment portion of the handle. Each attachment portion includes an upper leg-stop transition portion joined to an upper attachment stop. A lower attenuated attachment leg is joined to the upper attachment stop and terminates in a lower attachment stop. Each handle receiver includes first and second resilient jaws that define a receiver mouth and a receiver central opening. The resilient jaws are movable between a minimum retaining position and a maximum receiving position to facilitate securement of an attachment portion to a handle receiver.

19 Claims, 20 Drawing Sheets

CONTAINER CARRIER SYSTEM

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

TECHNICAL FIELD

The present disclosure relates to devices for enabling a user to carry multiple containers with one hand, and more particularly, to a container carrier system for securing and carrying at least two containers.

BACKGROUND OF THE INVENTION

Particularly given a general trend towards larger and larger volume beverage bottles, means have been sought to enable a person to carry more than a single bottle, and particularly to do so using only one hand. Because of the size, shape, and weight of liquid filled bottles, various carriers have been designed to allow a plurality of bottles to be releasably attached to one another for carrying. The present invention provides for and improves the art in a number of respects as detailed below.

SUMMARY OF THE INVENTION

In its most general configuration, the container carrier system advances the state of the art with a variety of new capabilities and overcomes many of the shortcomings of prior devices in new and novel ways. In its most general sense, the container carrier system overcomes the shortcomings and limitations of the prior art in any of a number of generally effective configurations.

Disclosed herein is a container carrier system for securing and carrying at least two containers. The container carrier system generally includes a handle and at least two retainer rings with a single retainer ring secured to a single container.

In one embodiment, the handle includes a carrying portion and at least two attachment portions. Each of the at least two attachment portions include an upper leg-stop transition portion joined to an upper attachment stop having an upper attachment stop diameter. Further, each of the at least two attachment portions include a lower attenuated attachment leg joined to the upper attachment stop and terminating in a lower attachment stop. The lower attenuated attachment leg has a lower attenuated attachment leg diameter, while the lower attachment stop has a lower attachment stop diameter.

In one embodiment, each of the at least two retainer rings includes at least one handle receiver for receiving and retaining a single attachment portion of the handle. The at least one handle receiver includes a first resilient jaw and a second resilient jaw that define a receiver mouth and a receiver central opening. The first resilient jaw and the second resilient jaw are movable between a minimum retaining position and a maximum receiving position. When the first resilient jaw and the second resilient jaw are in the minimum retaining position, the receiver mouth has a minimum receiver mouth width and the receiver central opening has a minimum receiver central opening diameter. Similarly, when the first resilient jaw and the second resilient jaw are in the maximum receiving position, the receiver mouth has a maximum receiver mouth width and the receiver central opening has a maximum receiver central opening diameter.

To facilitate the assembly and functionality of the container carrier system, portions of the handle and the retainer ring may be designed with particular relationships. For example, the upper attachment diameter may be greater than the minimum receiver central opening diameter and less than or equal to the maximum receiver central opening diameter. This relationship reduces the chance of the attachment portion separating from the handle receiver by preventing the upper attachment stop from reentering the receiver central opening when the first and second resilient jaws are in the minimum retaining position. Another example is the relationship between the lower attenuated attachment leg and the receiver mouth. The lower attenuated attachment leg diameter may be less than or equal to the maximum receiver mouth width, but greater than the minimum receiver mouth width. Such a relationship ensures that once the lower attenuated attachment leg is within the receiver central opening, the first and second resilient jaws must be moved beyond the minimum retaining position before the lower attenuated attachment leg may be removed from the handle receiver. Still another example is the configuration of the lower attachment stop. The lower attachment stop diameter may be greater than both the minimum and maximum receiver central opening diameter. This particular relationship ensures that the lower attachment stop provides a sufficient amount of surface area to bear against and support the handle receiver regardless of whether the first and second resilient jaws are in the minimum retaining position or the maximum receiving position.

Numerous alterations, modifications, and variations of the preferred embodiments disclosed herein will be apparent to those skilled in the art and they are all anticipated and contemplated to be within the spirit and scope of the disclosed container carrier system.

BRIEF DESCRIPTION OF THE DRAWINGS

Without limiting the scope of the present screw-type bottle neck having areas of reduced wall thickness claimed below and referring now to the drawings and figures:

Figure 1:
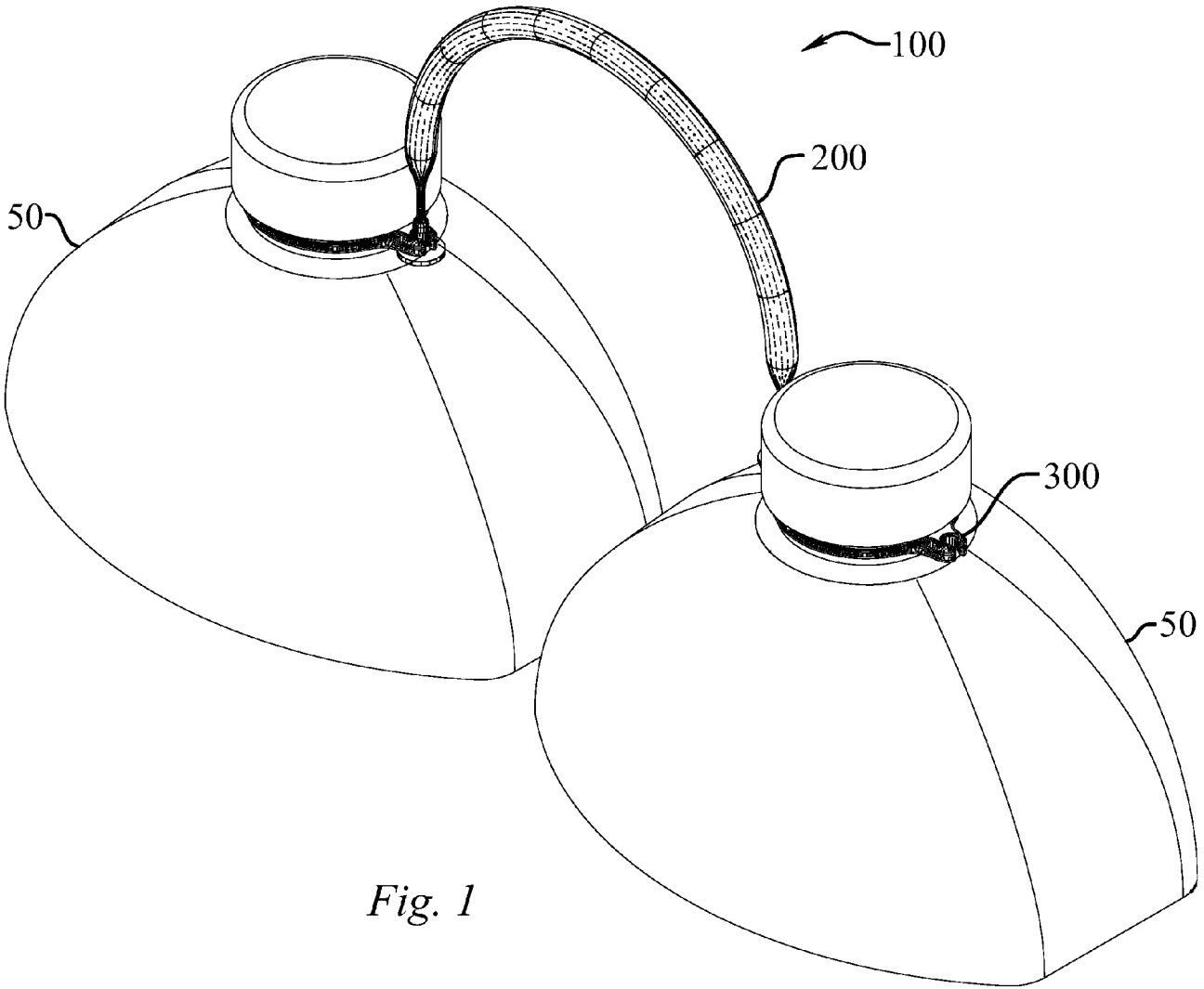
FIG. 1 is a perspective view of an embodiment of a container carrier system as applied to two containers, not to scale.
Figure 2:
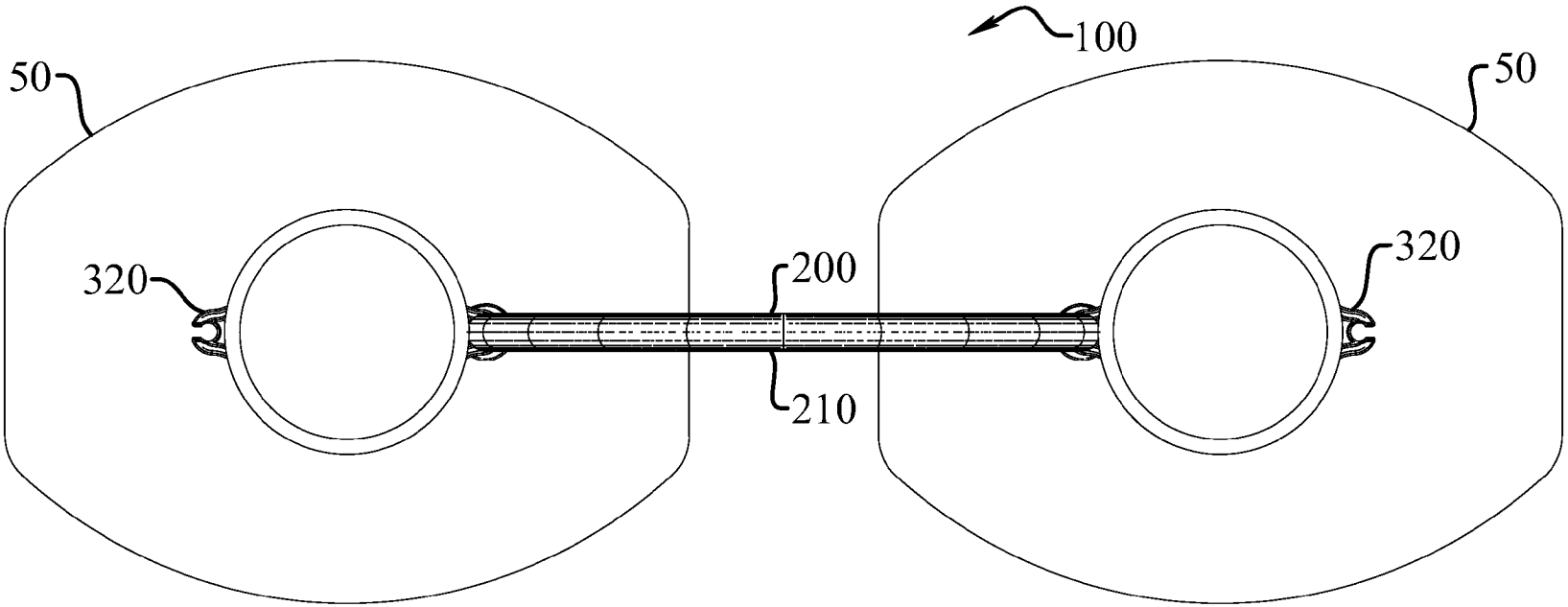
FIG. 2 is a top plan view of an embodiment of a container carrier system as applied to two containers, not to scale.

These drawings are provided to assist in the understanding of the exemplary embodiments of the container carrier system as described in more detail below and should not be construed as unduly limiting the claimed system. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The claimed container carrier system (100) enables a significant advance in the state of the art. The preferred embodiments of the container carrier system (100) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the container carrier system (100), and is not intended to represent the only form in which the container carrier system (100) may be constructed or utilized. The description sets forth the designs, functions, means, and methods of implementing the container carrier system (100) in connection with the illustrated embodiments. It is to be understood, however, that the same or equivalent functions and features may be accomplished by different embodiments that are also intended to be encompassed within the spirit and scope of the claimed container carrier system (100).

With reference generally to FIGS. 1-22*c*, a container carrier system (100) for securing and carrying at least two containers (50) is shown. The container carrier system (100) generally includes a handle (200) and at least two retainer rings (300). As seen in FIGS. 1-4, a single retainer ring (300) is secured to a single container (50) and each retainer ring (300) is configured to receive and retain a portion of the handle (200) to allow a user to easily carry multiple containers (50).

Figure 3:
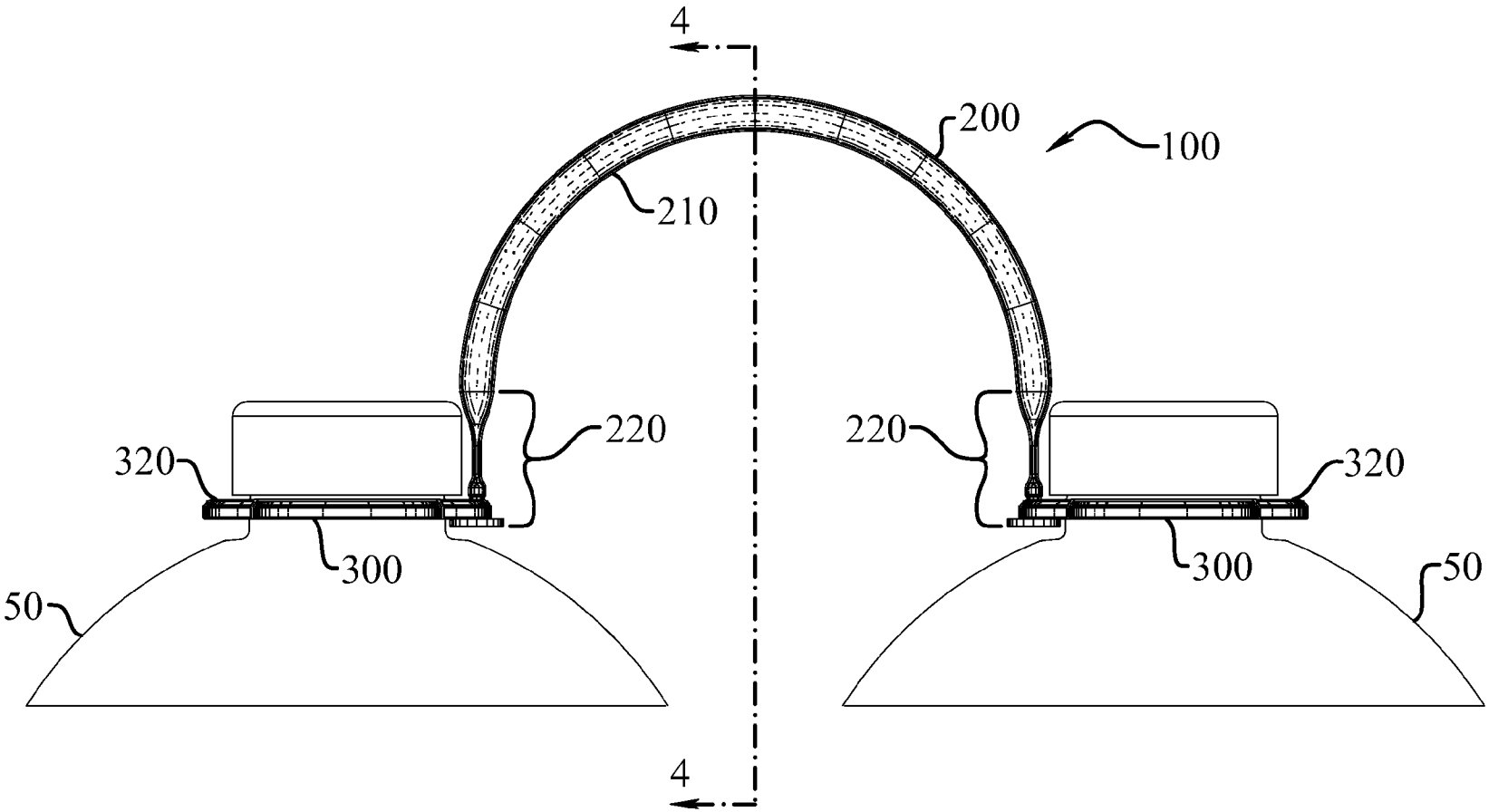
FIG. 3 is an elevation view of an embodiment of a container carrier system as applied to two containers, not to scale.
Figure 4:
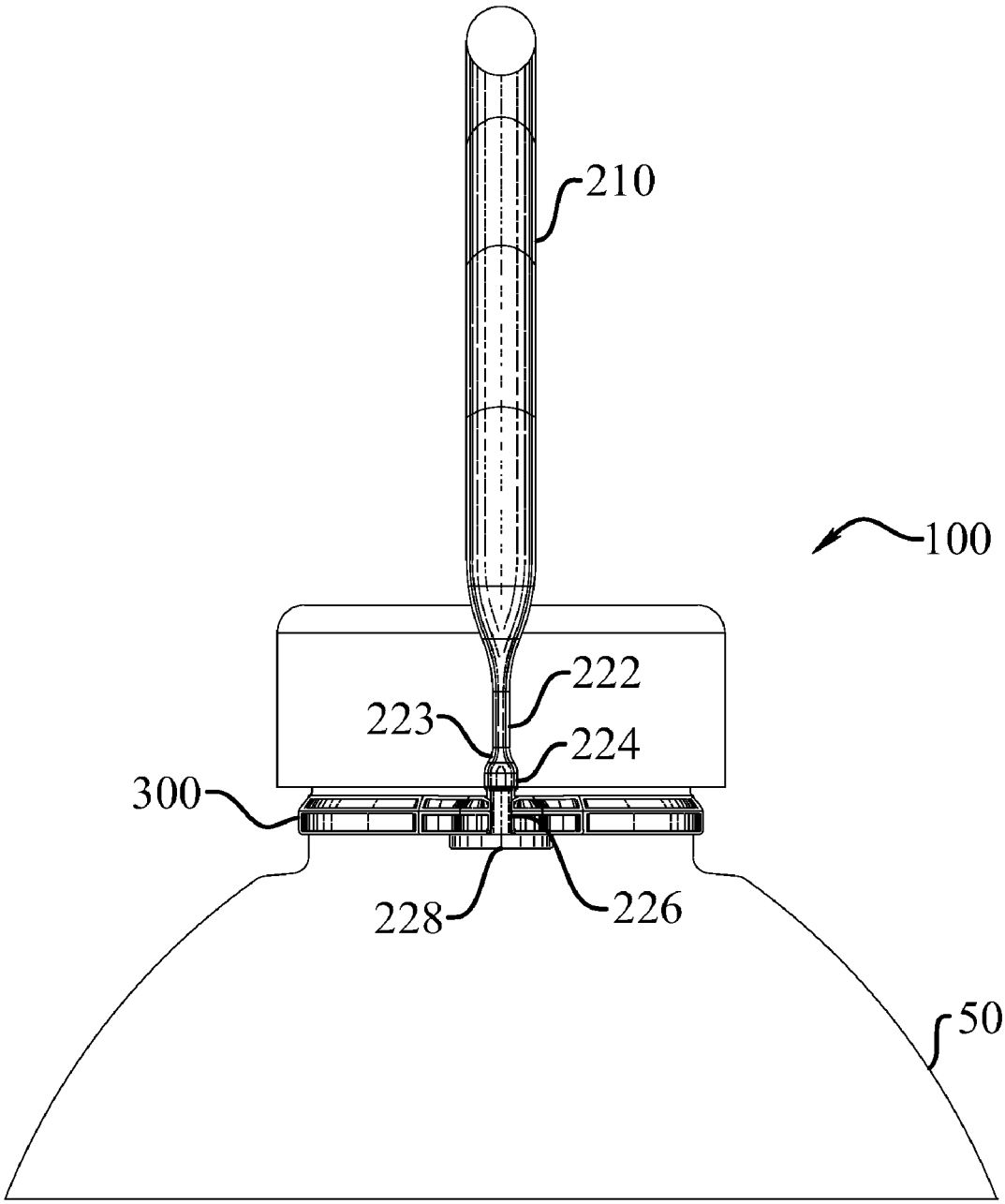
FIG. 4 is an elevation view of the embodiment of the container carrier system as viewed along section line 4-4 of FIG. 3, not to scale.
Figure 5:
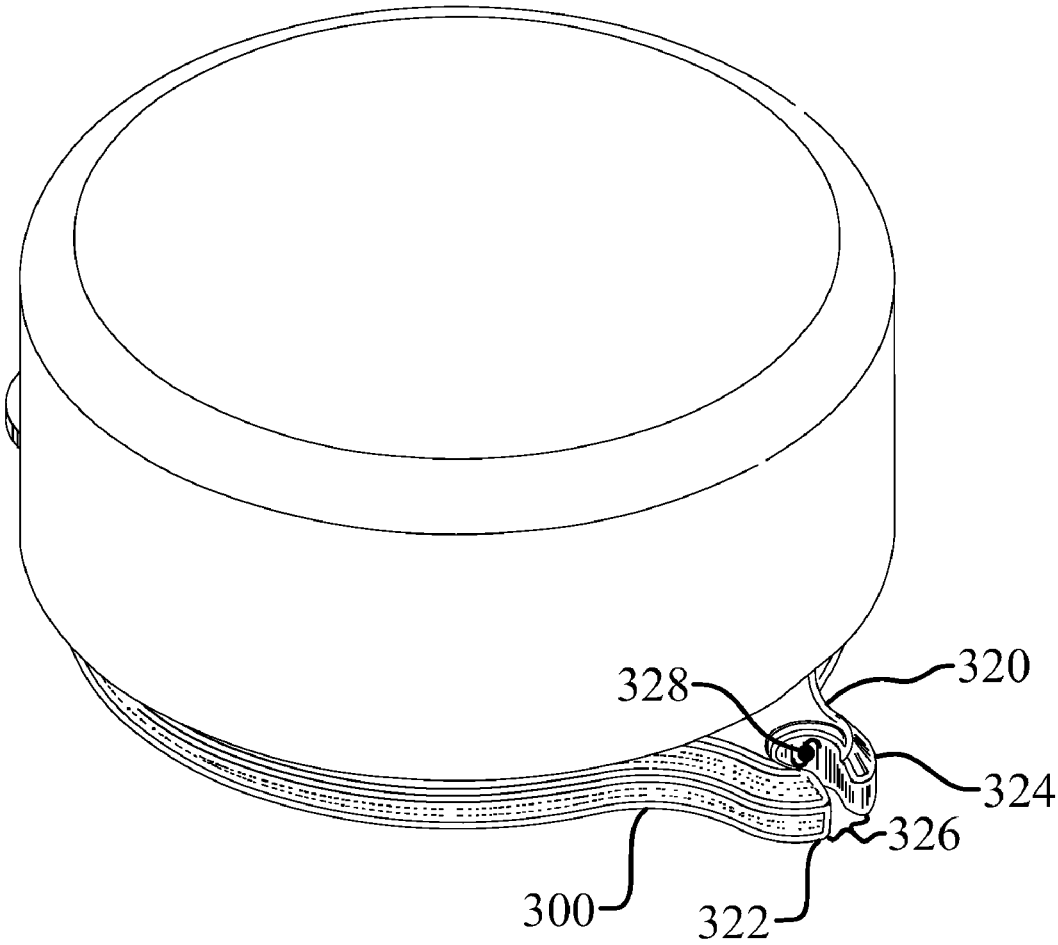
FIG. 5 is a perspective view of an embodiment of a retainer ring of the container carrier system, not to scale.
Figure 6:
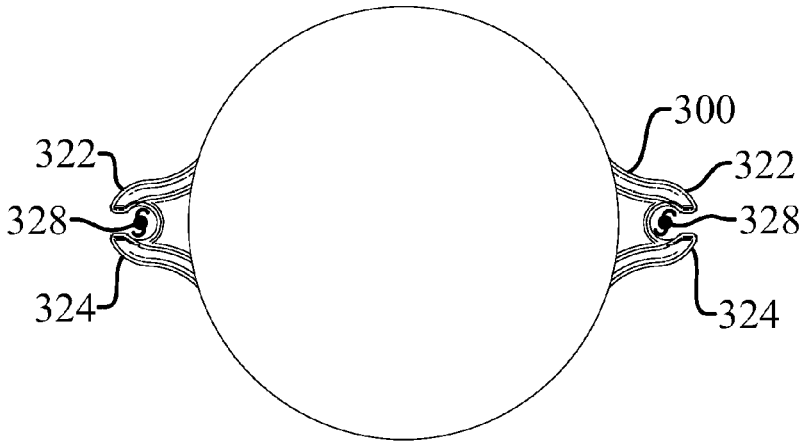
FIG. 6 is a top plan view of an embodiment of a retainer ring of the container carrier system, not to scale.
Figure 7:
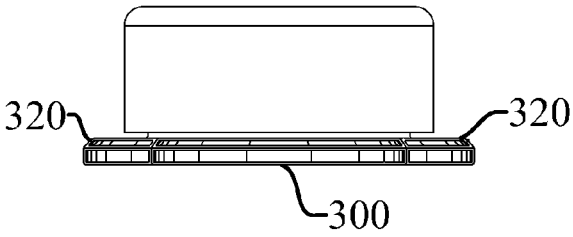
FIG. 7 is an elevation view of an embodiment of a retainer ring of the container carrier system, not to scale.
Figure 8:
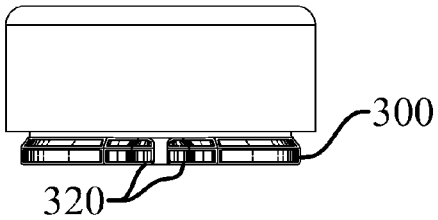
FIG. 8 is an elevation view of an embodiment of a retainer ring of the container carrier system, not to scale.
Figure 9:
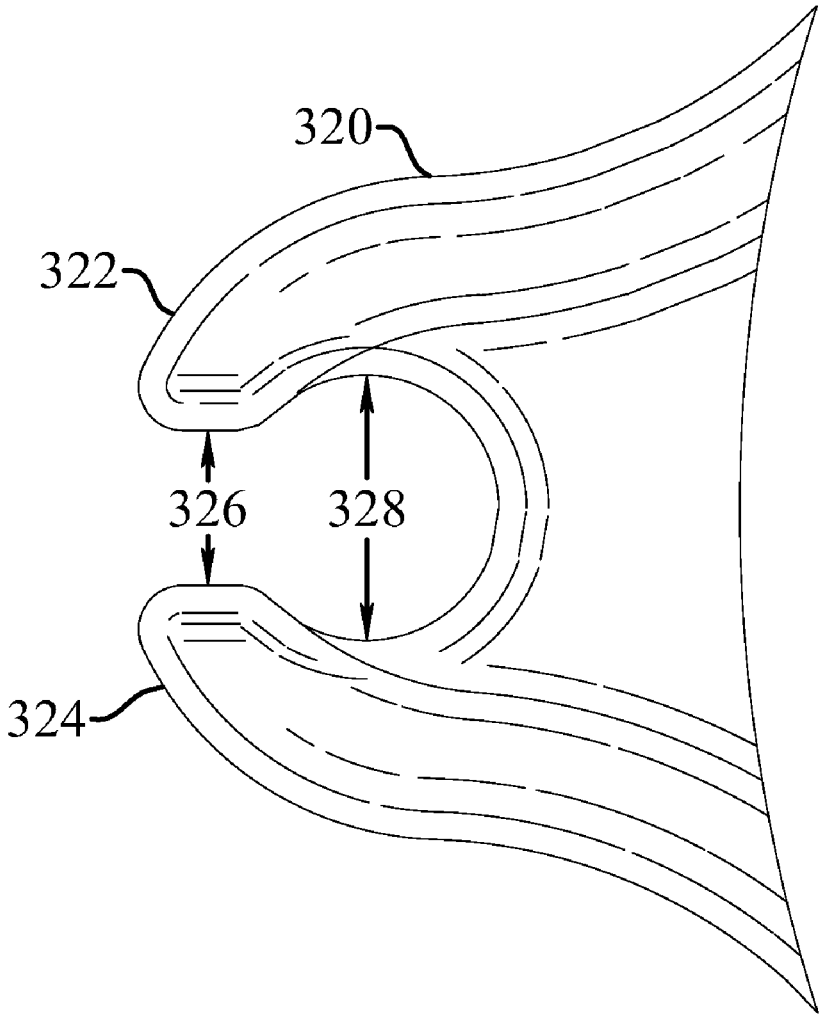
FIG. 9 is a detailed top plan view of a portion of the embodiment of the retainer ring of FIG. 6, not to scale.

Referring now to FIGS. 5-9, an embodiment of a retainer ring (300) is shown. As previously noted, a single retainer ring (300) is secured to a single container (50). The retainer ring (300) may be releasably secured to the container (50), or alternatively the retainer ring (300) may be fixedly secured to the container (50). In fact, the retainer ring (300) may be integral to the container (50). As seen in FIGS. 3 and 5, each retainer ring (300) includes at least one handle receiver (320) for receiving and retaining a portion of the handle (200). The handle receiver (320) has a first resilient jaw (322) and a second resilient jaw (324) with the first resilient jaw (322) and the second resilient jaw (324) defining a receiver mouth (326) and a receiver central opening (328), as best seen in FIG. 9.

Figure 10A:
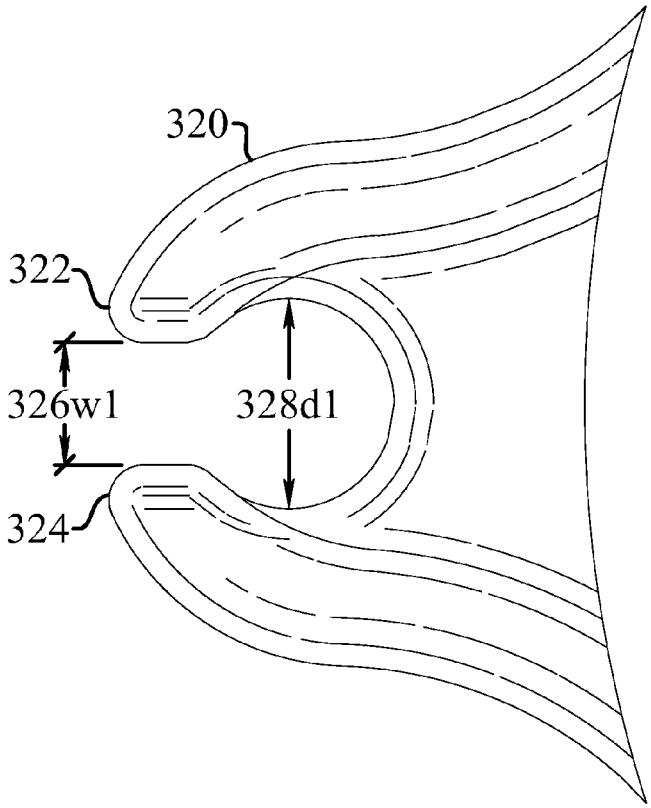
FIG. 10*a* is a detailed top plan view of a portion of the embodiment of the retainer ring of FIG. 6, not to scale.
Figure 10B:
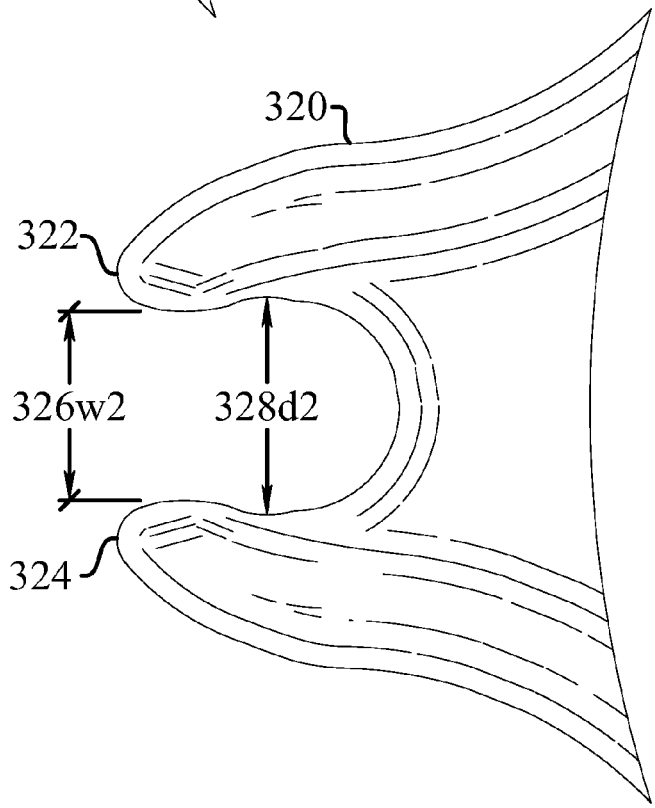
FIG. 10*b* is a detailed top plan view of a portion of the embodiment of the retainer ring of FIG. 6, not to scale.

As seen in FIGS. 10*a* and 10*b*, the first resilient jaw (322) and the second resilient jaw (324) are movable between a minimum retaining position and a maximum receiving position. When the first resilient jaw (322) and second resilient jaw (324) are in the minimum retaining position, the receiver mouth (326) has a minimum receiver mouth width (326*w*1) and the receiver central opening (328) has a minimum receiver central opening diameter (328*d*1), as seen in FIG. 10*a*. Similarly, when the first resilient jaw (322) and second resilient jaw (324) are in the maximum receiving position, the receiver mouth (326) has a maximum receiver mouth width (326*w*2) and the receiver central opening (328) has a maximum receiver central opening diameter (328*d*2), as seen in FIG. 10*b*.

Figure 11:
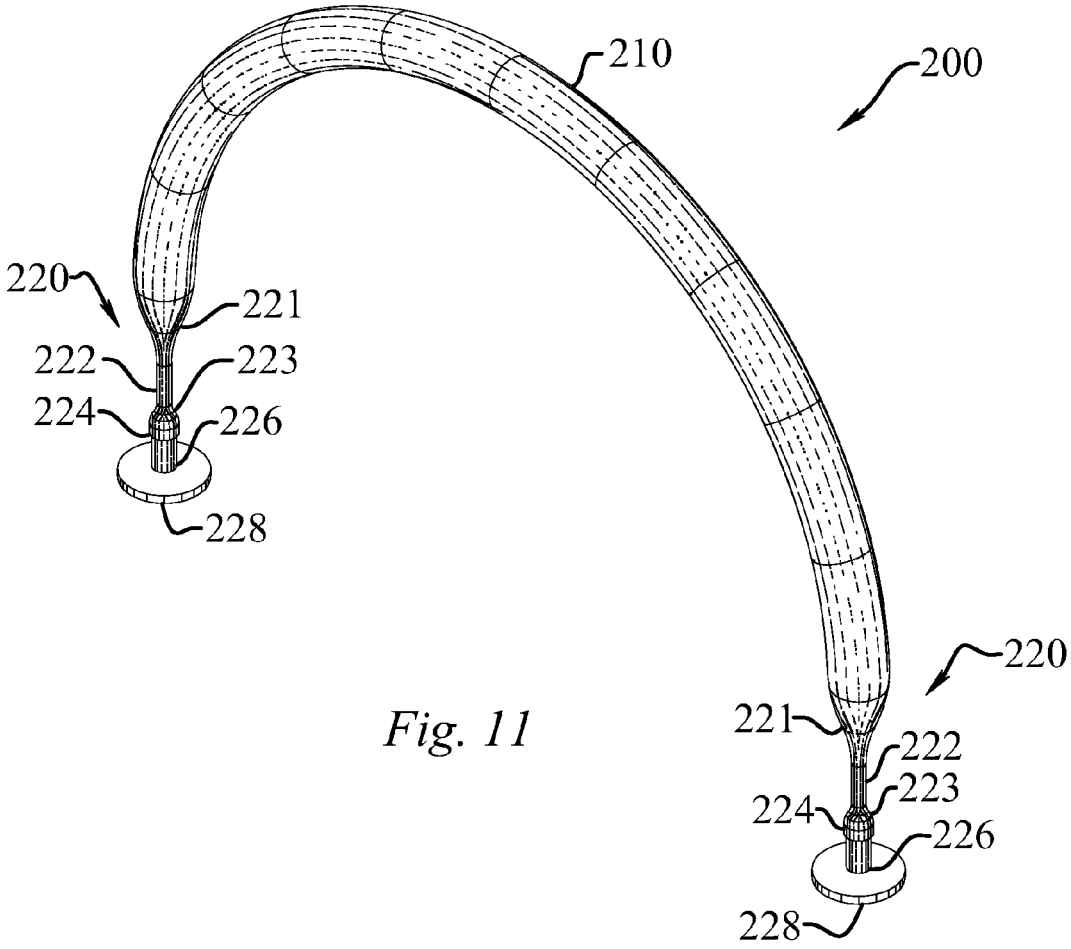
FIG. 11 is a perspective view of an embodiment of a handle of the container carrier system, not to scale.
Figure 12:
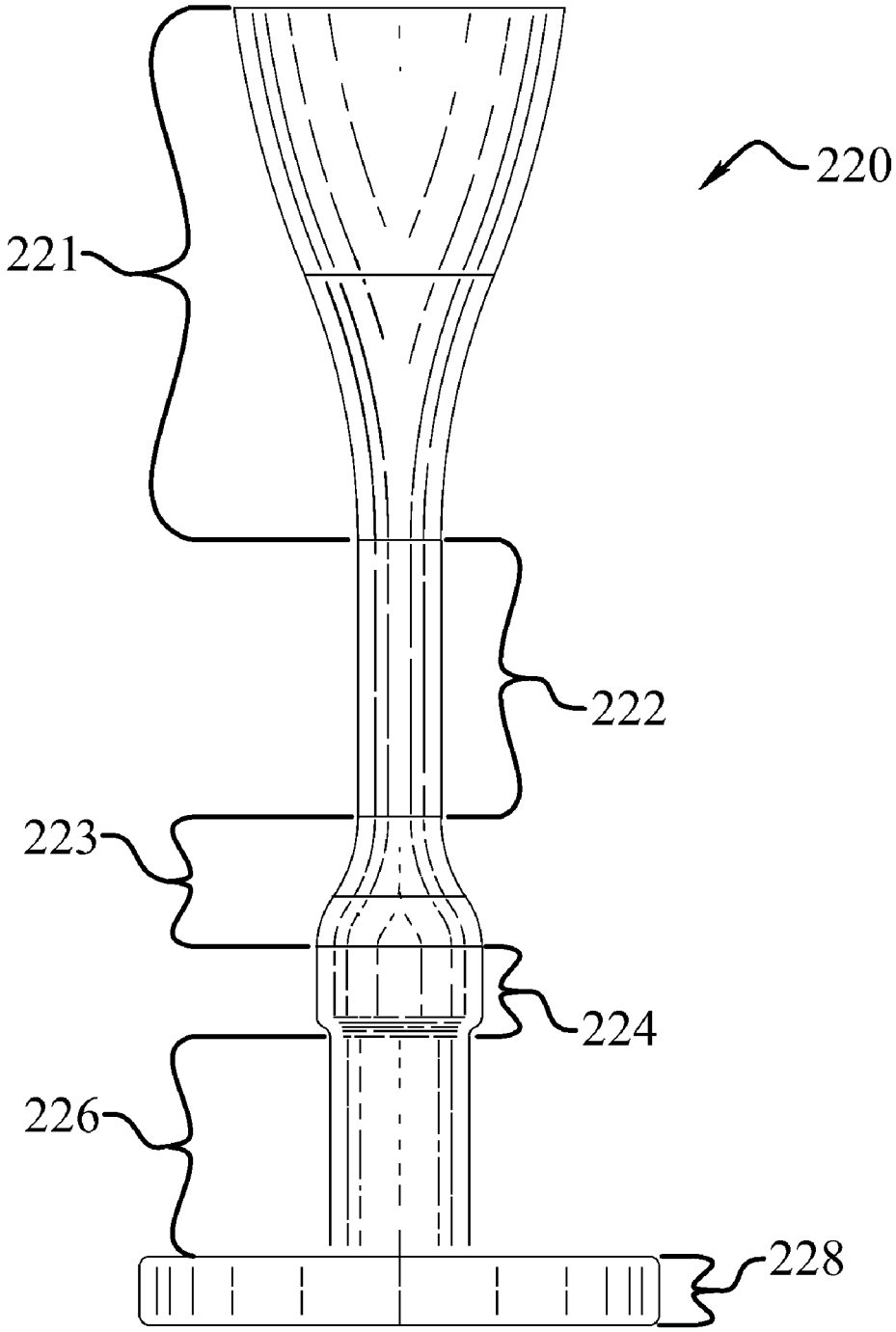
FIG. 12 is a detailed elevation view of a portion of the embodiment of the handle of FIG. 11, not to scale.
Figure 13:
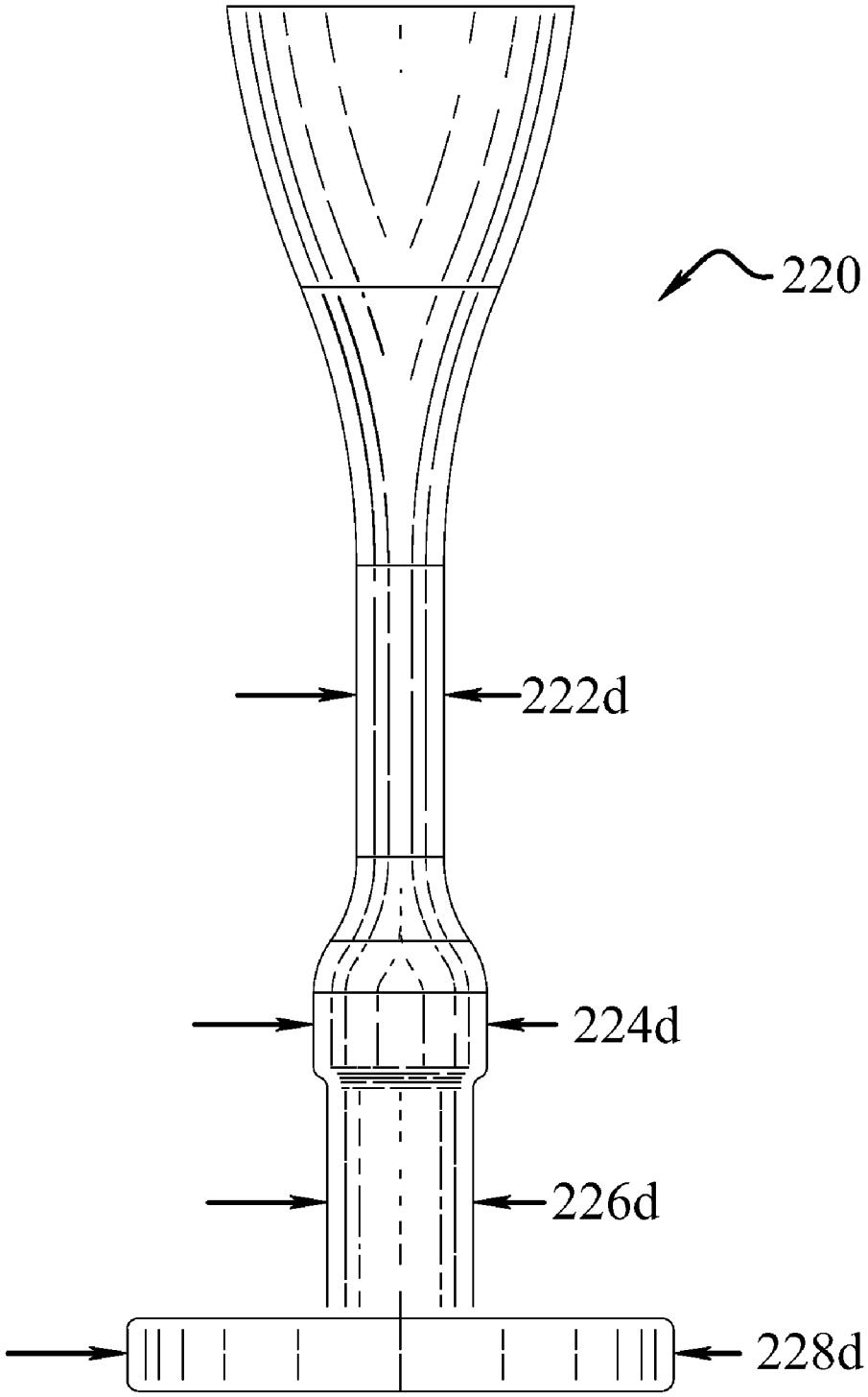
FIG. 13 is a detailed elevation view of a portion of the embodiment of the handle of FIG. 11, not to scale.
Figure 14B:
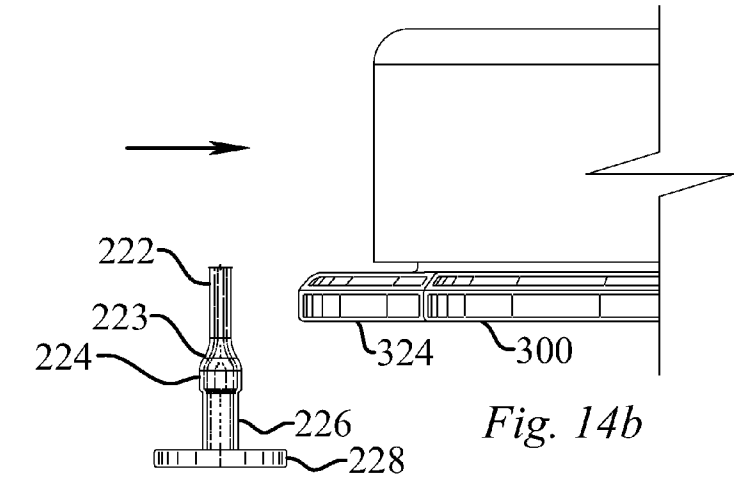
FIG. 14*b* is a side elevation view of an embodiment of an attachment portion and an embodiment of a handle receiver, not to scale.
Figure 14A:
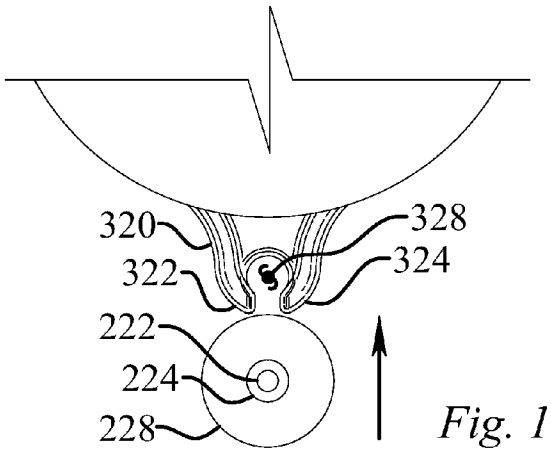
FIG. 14*a* is a top plan view of an embodiment of an attachment portion and an embodiment of a handle receiver, not to scale.
Figure 14C:
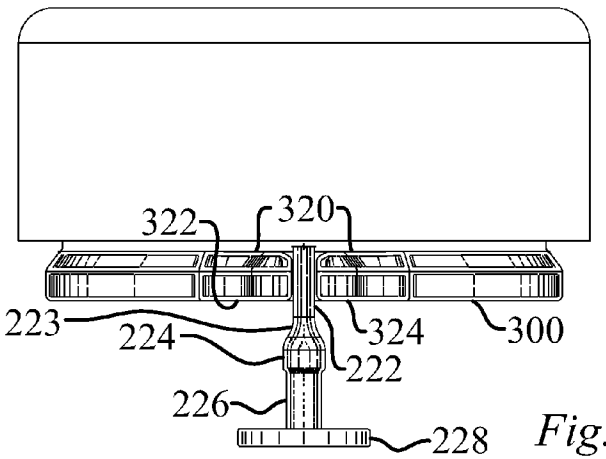
FIG. 14*c* is a front elevation view of an embodiment of an attachment portion and an embodiment of a handle receiver, not to scale.
Figure 15B:
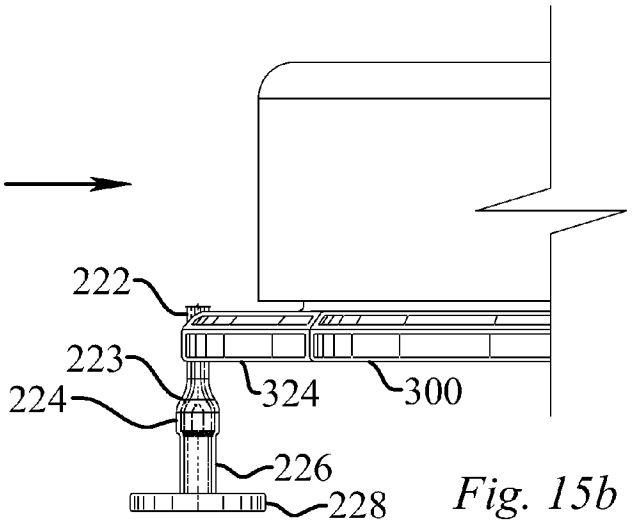
FIG. 15*b* is a side elevation view of an embodiment of an attachment portion and an embodiment of a handle receiver, not to scale.
Figure 15A:
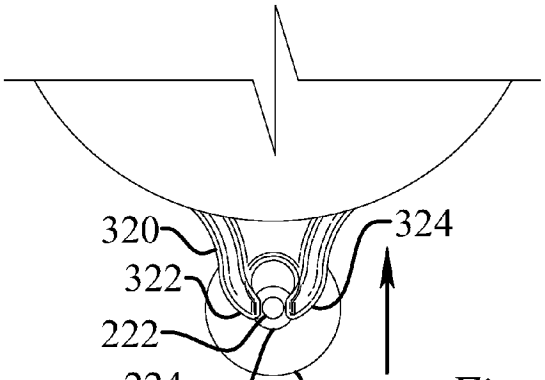
FIG. 15*a* is a top plan view of an embodiment of an attachment portion and an embodiment of a handle receiver, not to scale.
Figure 15C:
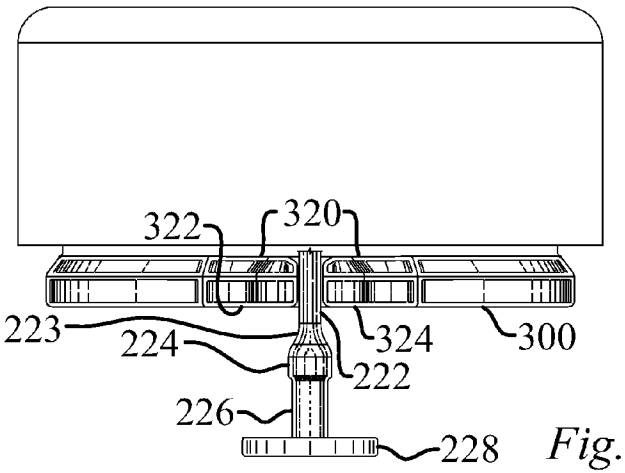
FIG. 15*c* is a front elevation view of an embodiment of an attachment portion and an embodiment of a handle receiver, not to scale.
Figure 16B:
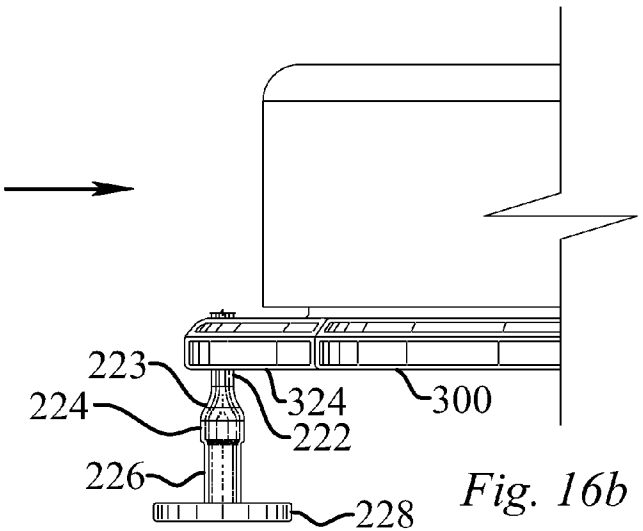
FIG. 16*b* is a side elevation view of an embodiment of an attachment portion and an embodiment of a handle receiver, not to scale.
Figure 16A:
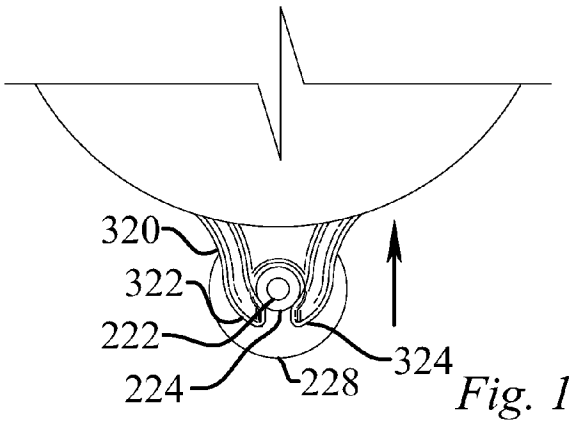
FIG. 16*a* is a top plan view of an embodiment of an attachment portion and an embodiment of a handle receiver, not to scale.
Figure 16C:
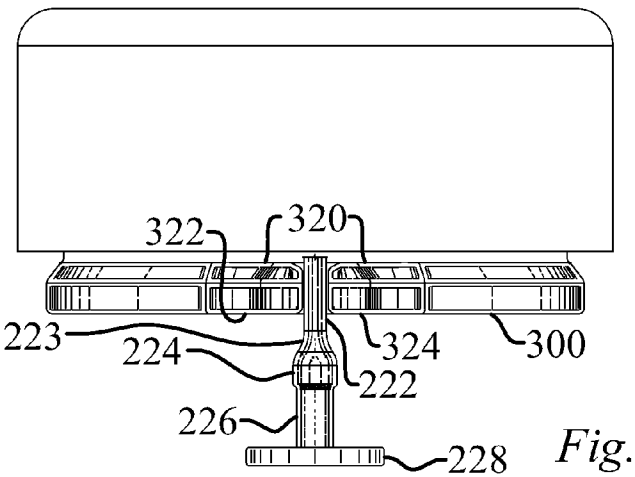
FIG. 16*c* is a front elevation view of an embodiment of an attachment portion and an embodiment of a handle receiver, not to scale.

Next, an embodiment of the handle (200) will be described. With reference to FIGS. 11-13, the handle (200) has a carrying portion (210) and at least two attachment portions (220). The at least two attachment portions (220) each include an upper leg-stop transition portion (223) joined to an upper attachment stop (224), and a lower attenuated attachment leg (226) joined to the upper attachment stop (224) and terminating in a lower attachment stop (228), as best seen in FIG. 12. Referring now to FIG. 13, the upper attachment stop (224) has an upper attachment stop diameter (224*d*), the lower attenuated attachment leg (226) has a lower attenuated attachment leg diameter (226*d*), and the lower attachment stop (228) has a lower attachment stop diameter (228*d*).

In an alternative embodiment of the handle (200), each of the at least two attachment portions (220) further includes an upper attenuated attachment leg (222) having an upper attenuated attachment leg diameter (222*d*), as best seen in FIGS. 12 and 13. Further, each of the at least two attachment portions (220) may include an upper connection transition portion (221) joined to the upper attenuated attachment leg (222), also seen in FIG. 12. The upper connection transition portion (221) is disposed between the carrying portion (210) and the upper attachment leg (222). Moreover, the upper connection transition portion (221) may comprise a frusto-conical portion. Preferably the frusto-conical portion has a diameter that decreases from the carrying portion (210) to the upper attenuated attachment leg (222).

Figure 17B:
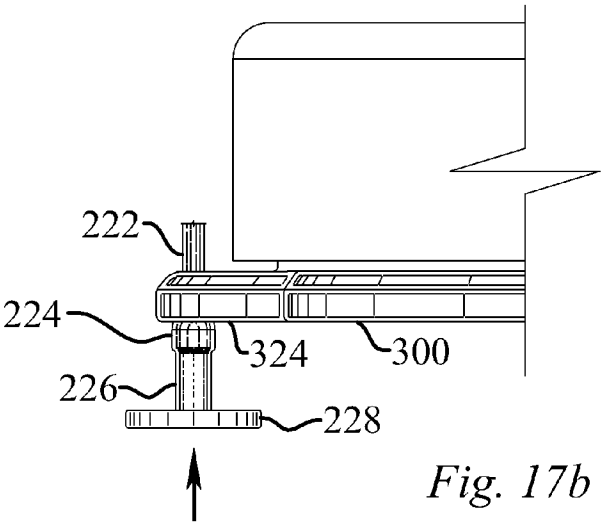
FIG. 17*b* is a side elevation view of an embodiment of an attachment portion and an embodiment of a handle receiver, not to scale.
Figure 17C:
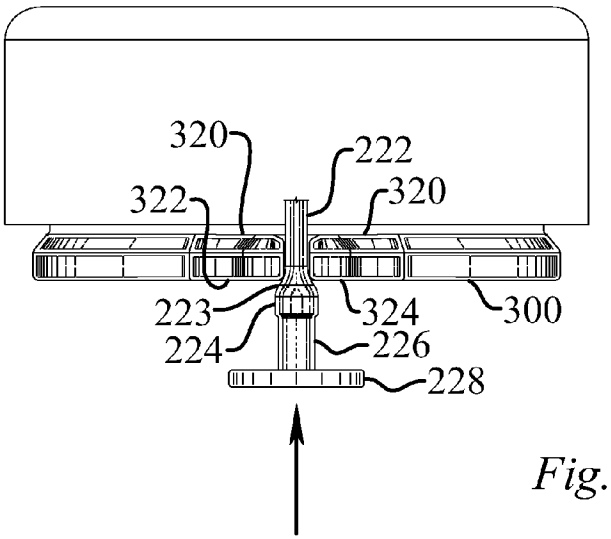
FIG. 17*c* is a front elevation view of an embodiment of an attachment portion and an embodiment of a handle receiver, not to scale.
Figure 17A:
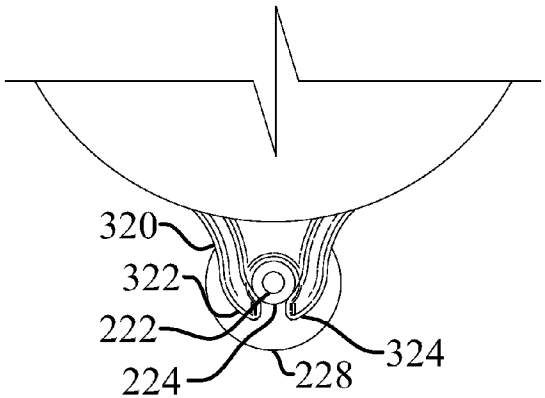
FIG. 17*a* is a top plan view of an embodiment of an attachment portion and an embodiment of a handle receiver, not to scale.
Figure 18B:
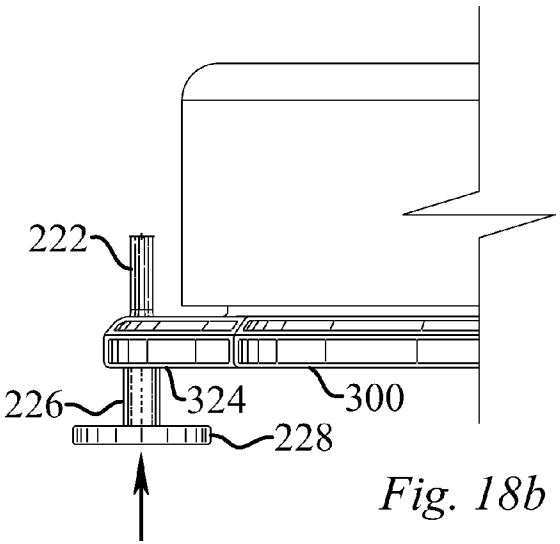
FIG. 18*b* is a side elevation view of an embodiment of an attachment portion and an embodiment of a handle receiver, not to scale.
Figure 18A:
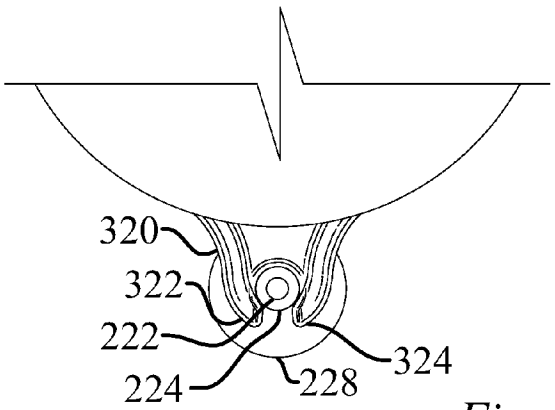
FIG. 18*a* is a top plan view of an embodiment of an attachment portion and an embodiment of a handle receiver, not to scale.
Figure 18C:
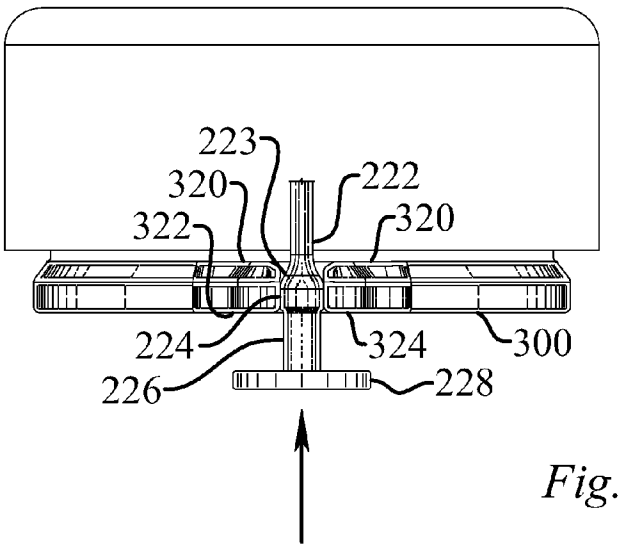
FIG. 18*c* is a front elevation view of an embodiment of an attachment portion and an embodiment of a handle receiver, not to scale.
Figure 19B:
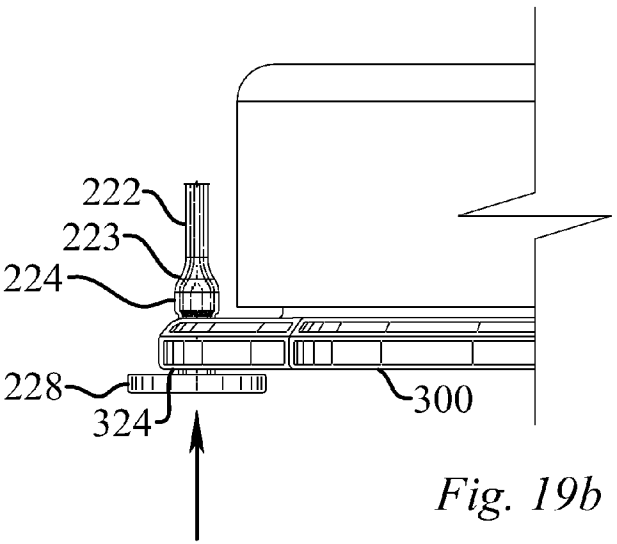
FIG. 19*b* is a side elevation view of an embodiment of an attachment portion and an embodiment of a handle receiver, not to scale.
Figure 19A:
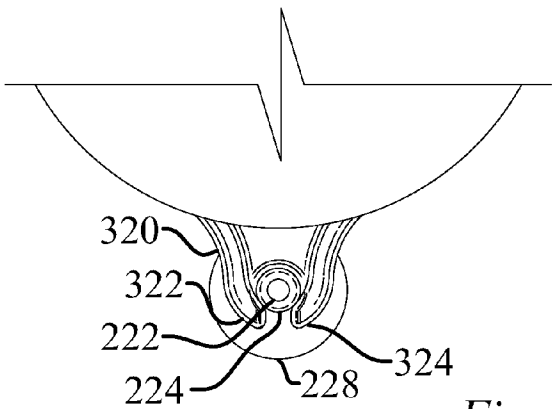
FIG. 19*a* is a top plan view of an embodiment of an attachment portion and an embodiment of a handle receiver, not to scale.
Figure 19C:
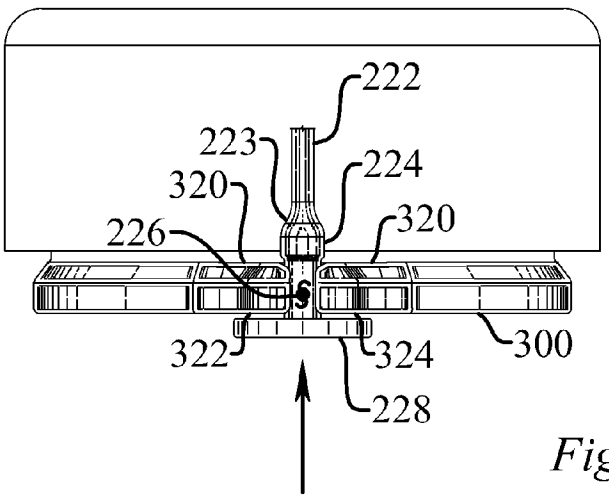
FIG. 19*c* is a front elevation view of an embodiment of an attachment portion and an embodiment of a handle receiver, not to scale.

Before the container carrier system (100) may be effectively utilized, the system (100) must be assembled by securing the handle (200) to the retainer ring (300) associated with each container (50). The handle (200) is secured to a retainer ring (300) by connecting an attachment portion (220) of the handle (200) to a handle receiver (320) and may be accomplished in several steps. As shown in FIGS. 14*a*-16*c*, the first step is to cause the upper attenuated attachment leg (222) to pass through the receiver mouth (326) and into the receiver central opening (328). Next, and as shown in FIGS. 17*a*-17*c*, an upward force, indicated by the arrow, is applied to the handle (200) so that the upper leg-stop transition portion (223) comes into contact with the first resilient jaw (322) and the second resilient jaw (324). By continuing to exert an upward force on the handle (200), the upper leg-stop transition portion (223) will cause the first resilient jaw (322) and the second resilient jaw (324) to move from the minimum retaining position to the maximum receiving position to allow the upper attachment stop (224) to enter the receiver central opening (328), as seen in FIGS. 18*a*-18*c*. With continued application of an upward force on the handle (200), the upper attachment stop (224) is caused to completely pass through the receiver central opening (328) allowing the lower attenuated attachment leg (226) to enter the receiver central opening (328), whereupon the first resilient jaw (322) and the second resilient jaw (324) bias back to the minimum retaining position, as seen in FIGS. 19*a*-19*c*. As seen in FIGS. 19*b*-19*c*, the lower attachment stop (228) is configured to bear against a portion of the handle receiver (320) to prevent further upward movement. At this point, the attachment portion (220) is effectively secured to the handle receiver (320). The preceding steps may be repeated to secure additional attachment portions (220) to additional handle receivers (320) so that multiple containers (50) may be secured and carried by the container carrier system (100).

Figure 20A:
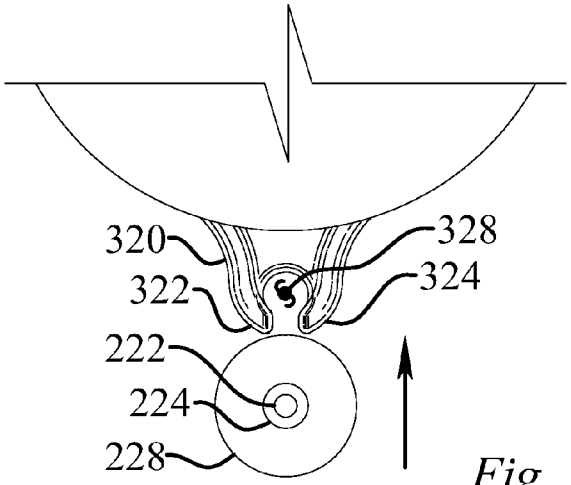
FIG. 20*a* is a top plan view of an embodiment of an attachment portion and an embodiment of a handle receiver, not to scale.
Figure 20B:
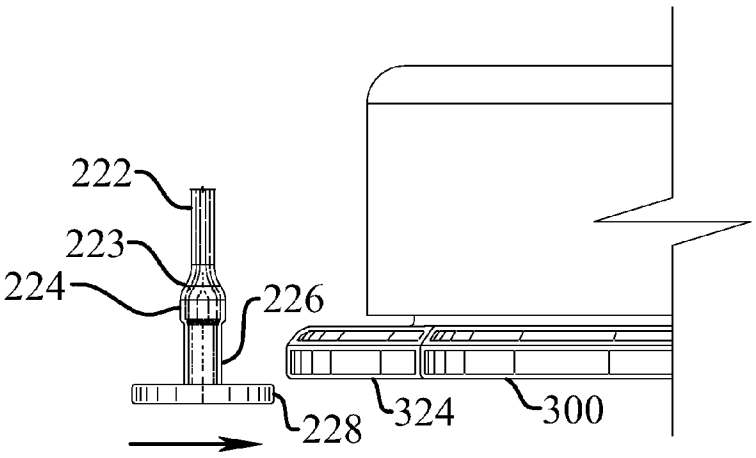
FIG. 20*b* is a side elevation view of an embodiment of an attachment portion and an embodiment of a handle receiver, not to scale.
Figure 20C:
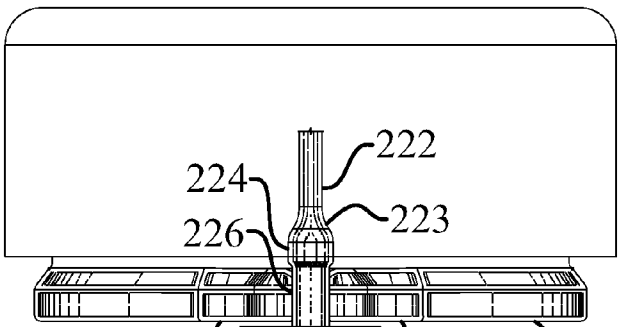
FIG. 20*c* is a front elevation view of an embodiment of an attachment portion and an embodiment of a handle receiver, not to scale.
Figure 21B:
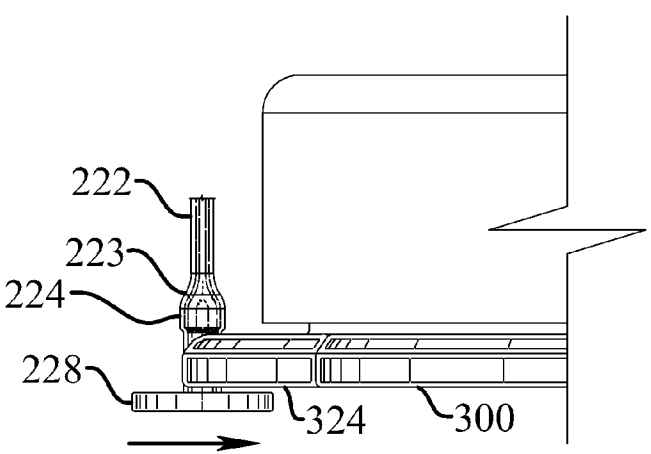
FIG. 21*b* is a side elevation view of an embodiment of an attachment portion and an embodiment of a handle receiver, not to scale.
Figure 21A:
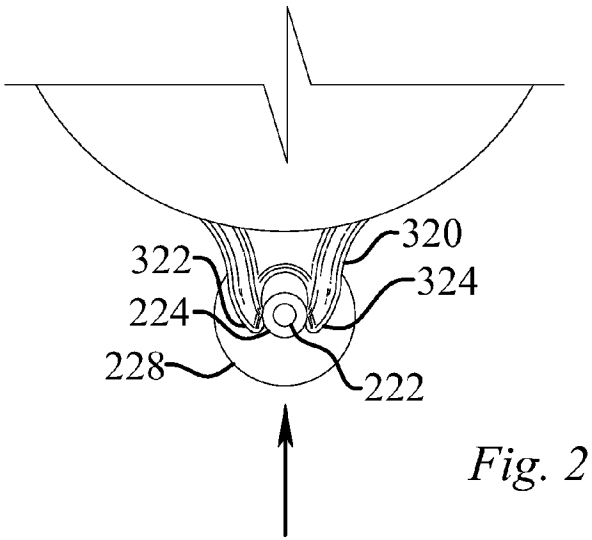
FIG. 21*a* is a top plan view of an embodiment of an attachment portion and an embodiment of a handle receiver, not to scale.
Figure 21C:
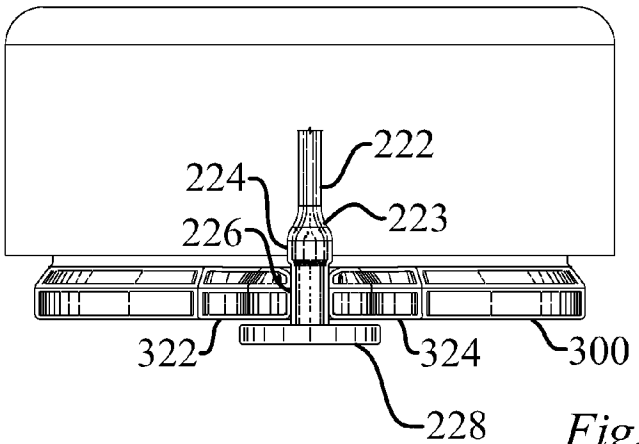
FIG. 21*c* is a front elevation view of an embodiment of an attachment portion and an embodiment of a handle receiver, not to scale.
Figure 22B:
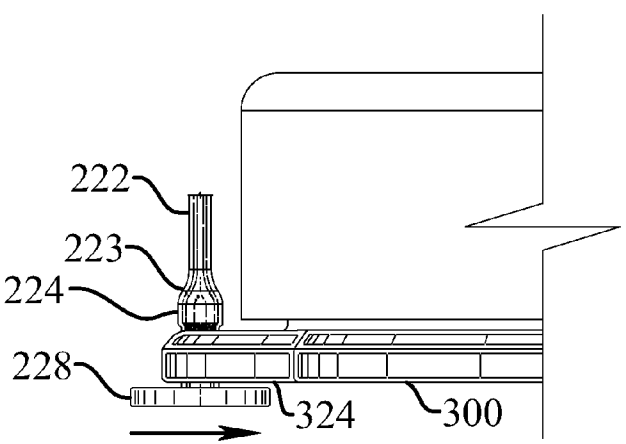
FIG. 22*b* is a side elevation view of an embodiment of an attachment portion and an embodiment of a handle receiver, not to scale.
Figure 22A:
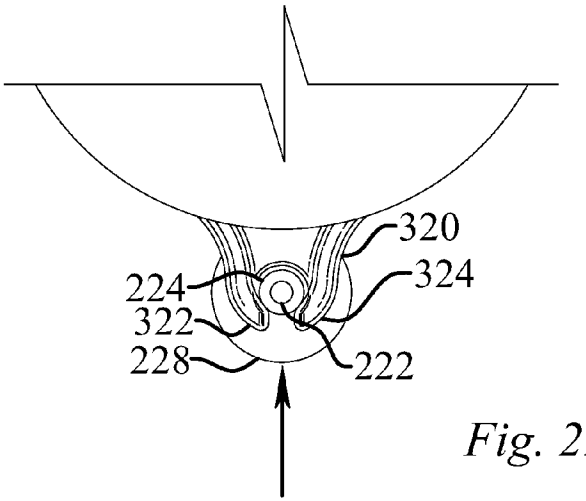
FIG. 22*a* is a top plan view of an embodiment of an attachment portion and an embodiment of a handle receiver, not to scale.
Figure 22C:
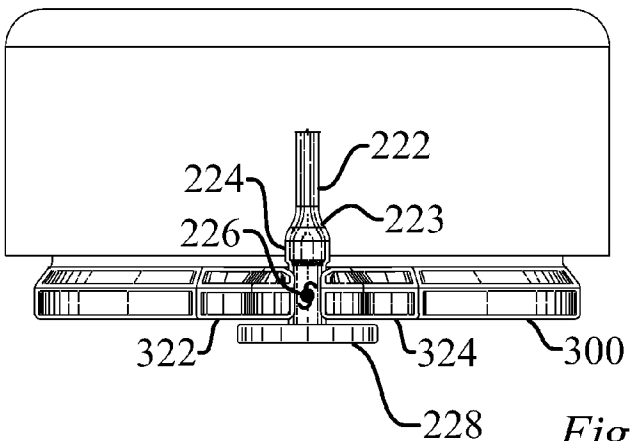
FIG. 22*c* is a front elevation view of an embodiment of an attachment portion and an embodiment of a handle receiver, not to scale.

Assembling the container carrier system (100) may also be accomplished by an alternative process depicted in FIGS. 20*a*-22*c*. In this particular process, the lower attenuated attachment leg (226) is first aligned with the receiver mouth (326), as seen in FIGS. 20*a*-20*c*. Next, a force, indicated by the arrow, is applied to the lower attenuated attachment leg (226) causing it to enter the receiver mouth (326). As the lower attenuated attachment leg (226) enters the receiver mouth (326), the first resilient jaw (322) and the second resilient jaw (324) are moved from the minimum retaining position to the maximum receiving position, as seen in FIGS. 21*a*-21*c*. With continued application of the force, the lower attenuated attachment leg (226) passes completely through the receiver mouth (326) and enters the receiver central opening (328), whereupon the first resilient jaw (322) and the second resilient jaw (324) bias back to the minimum retaining position, as seen in FIGS. 22*a*-22*c*. At this point, the attachment portion (220) is effectively secured to the handle receiver (320). The preceding steps may be repeated to secure additional attachment portions (220) to additional handle receivers (320) so that multiple containers (50) may be secured and carried by the container carrier system (100).

To facilitate the assembly and functionality of the container carrier system (100), portions of the handle (200) and the retainer ring (300) may be designed with particular relationships. For example, in an embodiment of the handle (200) having an upper attenuated attachment leg (222), the upper attenuated attachment leg (222) is preferably configured to easily pass through the receiver mouth (326) and into the receiver central opening (328). In a particular embodiment, the upper attenuated attachment leg diameter (222*d*) is less than or equal to the minimum receiver mouth width (326*w*1). Furthermore, the upper attenuated attachment leg diameter (222*d*) may be less than the minimum receiver central opening diameter (328*d*1). Such relationships ensure that the upper attenuated attachment leg (222) may easily gain entrance into the receiver central opening (328) through the receiver mouth (326) to begin the assembly process of the container carrier system (100).

The upper leg-stop transition portion (223) is particularly designed to facilitate assembly of the container carrier system (100). As previously noted, the upper leg-stop transition portion (223) is the component of the attachment portion (220) that is joined to the upper attachment stop (224). To facilitate assembly, the upper leg-stop transition portion (223) is configured to cooperate with the receiver central opening (328) to cause the first resilient jaw (322) and the second resilient jaw (324) to move from the minimum retaining position to the maximum receiving position. As previously mentioned, when the first resilient jaw (322) and the second resilient jaw (324) are in the maximum receiving position, the upper attachment stop (224) is allowed to enter and pass completely through the receiver central opening (328). In a particular embodiment, the upper leg-stop transition portion (223) comprises a frusto-conical portion, as best seen in FIG. 12. The frusto-conical portion may have a varying diameter with a minimum diameter that is less than the minimum receiver central opening diameter (328*d*1) that increases to a maximum diameter that is equal to the upper attachment stop diameter (224*d*). With this configuration, a portion of the upper leg-stop transition portion (223) may easily pass through the receiver central opening (328) until a wider portion of the upper leg-stop transition portion (223) causes the first resilient jaw (322) and the second resilient jaw (324) to begin to move from the minimum retaining position to the maximum receiving position.

While releasable securement of the attachment portion (220) to the handle receiver (320) is envisioned, several components of the attachment portion (220) and the handle receiver (320) are configured to prevent the unintentional separation of an attachment portion (220) from a handle receiver (320). For example, in one embodiment, the upper attachment stop (224) may have an upper attachment stop diameter (224*d*) that is greater than the minimum receiver central opening diameter (328*d*1) and that is less than or equal to the maximum receiver central opening diameter (328*d*2). Further, the upper attachment stop diameter (224*d*) may be at least ten percent greater than the minimum receiver central opening diameter (328*d*1). These particular relationships ensure that the upper attachment stop (224) is allowed to pass through the receiver central opening (328) when the first and second resilient jaws (322, 324) are in the maximum receiving position, but prevents the upper attachment stop (224) from reentering the receiver central opening (328) when the first and second resilient jaws (322, 324) are in the minimum retaining position, which could lead to separation of the attachment portion (220) from the handle receiver (320).

Moreover, the lower attenuated attachment leg (226) and the handle receiver (320) may be designed to prevent unintentional separation of an attachment portion (220) from a handle receiver (320). For example, the lower attenuated attachment leg diameter (226*d*) may be greater than the minimum receiver mouth width (326*w*1) and less than or equal to the maximum receiver mouth width (326*w*2). Still further, the lower attenuated attachment leg diameter (226*d*) may be at least thirty percent greater than the minimum receiver mouth width (326*w*1). These relationships prevent unintentional separation by ensuring that once the lower attenuated attachment leg (226) is within the receiver central opening (328), the first and second resilient jaws (322, 324) must be moved beyond the minimum retaining position before the lower attenuated attachment leg (226) may be removed from the handle receiver (320).

In other embodiments, the lower attenuated attachment leg (226) and the handle receiver (320) may be designed to promote a strong structural engagement between the handle (200) and the retainer ring (300). For example, the lower attenuated attachment leg (226) may have a lower attenuated attachment leg diameter (226*d*) that is greater than or equal to the minimum receiver central opening diameter (328*d*1). Moreover, the lower attenuated attachment leg (226) may have a lower attenuated attachment leg diameter (226*d*) that is at least five percent greater than the minimum receiver central opening diameter (328*d*1). By providing a lower attenuated attachment leg diameter (226*d*) that is equal to or slightly greater than the minimum receiver central opening diameter (328*d*1), secure engagement between the lower attenuated attachment leg (226) and the handle receiver (320) is promoted due to the resilient nature of the first and second resilient jaws (322, 324).

As previously mentioned, the lower attachment stop (228) is configured to bear against the handle receiver (320) to aid in the releasable securement of the handle (200) to the retainer ring (300). In one embodiment, the lower attachment stop (228) has a lower attachment stop diameter (228*d*) that is greater than both the minimum receiver central opening diameter (328*d*1) and the maximum receiver central opening diameter (328*d*2). This relationship ensures that the lower attachment stop (228) provides a sufficient amount of surface area to bear against and support the handle receiver (320) regardless of whether the first and second resilient jaws (322, 324) are in the minimum retaining position or the maximum receiving position.

In another embodiment, the handle (200) may be configured to minimize contact between the attachment portion (220) and the container (50). In this particular embodiment, when the handle (200) is secured to the retainer rings (300), the handle (200) is spaced from the containers (50), as seen in FIG. 3. To create this spacing, the attachment portions (220) may further include an upper connection transition portion (221) disposed between the carrying portion (210) and the upper attachment leg (222), as seen in FIG. 12. Moreover, the upper connection transition portion (221) may comprise a frusto-conical portion. Preferably the frusto-conical portion has a diameter that decreases from the carrying portion (210) to the upper attenuated attachment leg (222).

The handle (200) and the at least two retainer rings (300) may be formed of various materials. Preferably, the handle (200) and the at least two retainer rings (300) are formed of plastic materials, including but not limited to, polyethylene, polystyrene, polyvinyl chloride, polytetrafluoroethylene, HDPE, LDPE, and polyethylene terephthalate, just to name a few. The material used for the handle (200) and the at least two retainer rings (300) should be durable, yet also resilient.

The container carrier system (100) may be configured in various sizes and resilient materials so as to vary the amount of force required to move the first resilient jaw (322) and the second resilient jaw (324) between the minimum retaining position and the maximum receiving position, as would be well-known to one skilled in the art. In particular, different embodiments may require a force of not less than two, five, ten, or even more pounds, to be collectively applied to the first resilient jaw (322) and the second resilient jaw (324). In some embodiments, the force need not be equally applied to both the first resilient jaw (322) and the second resilient jaw (324).

Movement of the first resilient jaw (322) and the second resilient jaw (324) need not be entirely elastic, and in different embodiments, movement of the first resilient jaw (322) and the second resilient jaw (324) may vary from five percent elastic to fully elastic, and in some particular embodiments, may be between fifty and ninety percent elastic. Similarly, the container carrier system (100) may not necessarily be comprised of a single material or have a singular resiliency, and may also be formed with a plurality of portions having a plurality of resiliencies.

It should be noted that although the container carrier system (100) is shown throughout the figures as being used with only two containers (50), the system (100) may be used with more than two containers (50). For example, the handle (200) may contain multiple branches that terminate in an attachment portion (220), with each attachment portion (220) being capable of being secured to a separate container (50) having a retainer ring (300) secured thereto.

Numerous alterations, modifications, and variations of the preferred embodiments disclosed herein will be apparent to those skilled in the art and they are all anticipated and contemplated to be within the spirit and scope of the claimed container carrier system (100). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the container carrier system (100) are described herein, it is to be understood that the practice of such additional modifications and variations and the equivalents thereof, are within the spirit and scope of the container carrier system (100) as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A container carrier system (100) for securing and carrying at least two containers (50) comprising:

(a) a handle (200) having a carrying portion (210) and at least two attachment portions (220), wherein each of the at least two attachment portions (220) include:

(i) an upper leg-stop transition portion (223) joined to an upper attachment stop (224), wherein the upper attachment stop (224) has an upper attachment stop diameter (224*d*); and (ii) a lower attenuated attachment leg (226) joined to the upper attachment stop (224) and terminating in a lower attachment stop (228), wherein the lower attenuated attachment leg (226) has a lower attenuated attachment leg diameter (226*d*) and the lower attachment stop (228) has a lower attachment stop diameter (228*d*);

(b) at least two retainer rings (300) with a single retainer ring (300) secured to a single container (50), wherein each of the at least two retainer rings (300) includes at least one handle receiver (320) for receiving and retaining a single attachment portion (220) of the handle (200), the at least one handle receiver (320) having a first resilient jaw (322) and a second resilient jaw (324) with the first resilient jaw (322) and the second resilient jaw (324) defining a receiver mouth (326) and a receiver central opening (328), wherein the first resilient jaw (322) and the second resilient jaw (324) are movable between a minimum retaining position and a maximum receiving position;

(c) wherein when the first resilient jaw (322) and the second resilient jaw (324) are in the minimum retaining position, the receiver mouth (326) has a minimum receiver mouth width (326*w*1) and the receiver central opening (328) has a minimum receiver central opening diameter (328*d*1), and when the first resilient jaw (322) and the second resilient jaw (324) are in the maximum receiving position, the receiver mouth (326) has a maximum receiver mouth width (326*w*2) and the receiver central opening (328) has a maximum receiver central opening diameter (328*d*2); and (d) wherein:

(i) the upper attachment stop diameter (224*d*) is greater than the minimum receiver central opening diameter (328*d*1) and the upper attachment stop diameter (224*d*) is less than or equal to the maximum receiver central opening diameter (328*d*2);

(ii) the lower attenuated attachment leg diameter (226*d*) is less than or equal to the maximum receiver mouth width (326*w*2) and the lower attenuated attachment leg diameter (226*d*) is greater than the minimum receiver mouth width (326*w*1); and (iii) the lower attachment stop diameter (228*d*) is greater than the minimum receiver central opening diameter (328*d*1) and the maximum receiver central opening diameter (328*d*2).

2. The container carrier system (100) of claim 1, wherein each of the at least two attachment portions (220) further include an upper attenuated attachment leg (222) having an upper attenuated attachment leg diameter (222*d*), wherein the upper attenuated attachment leg diameter (222*d*) is less than or equal to the minimum receiver mouth width (326*w*1).

3. The container carrier system (100) of claim 2, wherein the upper attenuated attachment leg diameter (222*d*) is less than the minimum receiver central opening diameter (328*d*1).

4. The container carrier system (100) of claim 2, wherein each of the at least two attachment portions (220) further include an upper connection transition portion (221) joined to the upper attenuated attachment leg (222).

5. The container carrier system (100) of claim 4, wherein the upper connection transition portion (221) comprises a frusto-conical portion.

6. The container carrier system (100) of claim 1, wherein the lower attenuated attachment leg diameter (226*d*) is greater than or equal to the minimum receiver central opening diameter (328*d*1).

7. The container carrier system (100) of claim 1, wherein the lower attenuated attachment leg diameter (226*d*) is at least five percent greater than the minimum receiver central opening diameter (328*d*1).

8. The container carrier system (100) of claim 1, wherein the upper leg-stop transition portion (223) comprises a frusto-conical portion.

9. The container carrier system (100) of claim 1, wherein the upper attachment stop diameter (224*d*) is at least ten percent greater than the minimum receiver central opening diameter (328*d*1).

10. The container carrier system (100) of claim 1, wherein the lower attenuated attachment leg diameter (226*d*) is at least thirty percent greater than the minimum receiver mouth width (326*w*1).

11. A container carrier system (100) for securing and carrying at least two containers (50) comprising:

(a) a handle (200) having a carrying portion (210) and at least two attachment portions (220), wherein each of the at least two attachment portions (220) include:

(i) an upper leg-stop transition portion (223), comprising a frusto-conical portion, joined to an upper attachment stop (224), wherein the upper attachment stop (224) has an upper attachment stop diameter (224*d*); and (ii) a lower attenuated attachment leg (226) joined to the upper attachment stop (224) and terminating in a lower attachment stop (228), wherein the lower attenuated attachment leg (226) has a lower attenuated attachment leg diameter (226*d*) and the lower attachment stop (228) has a lower attachment stop diameter (228*d*);

(b) at least two retainer rings (300) with a single retainer ring (300) secured to a single container (50), wherein each of the at least two retainer rings (300) includes at least one handle receiver (320) for receiving and retaining a single attachment portion (220) of the handle (200), the at least one handle receiver (320) having a first resilient jaw (322) and a second resilient jaw (324) with the first resilient jaw (322) and the second resilient jaw (324) defining a receiver mouth (326) and a receiver central opening (328), wherein the first resilient jaw (322) and the second resilient jaw (324) are movable between a minimum retaining position and a maximum receiving position;

(c) wherein when the first resilient jaw (322) and the second resilient jaw (324) are in the minimum retaining position, the receiver mouth (326) has a minimum receiver mouth width (326*w*1) and the receiver central opening (328) has a minimum receiver central opening diameter (328*d*1), and when the first resilient jaw (322) and the second resilient jaw (324) are in the maximum receiving position, the receiver mouth (326) has a maximum receiver mouth width (326*w*2) and the receiver central opening (328) has a maximum receiver central opening diameter (328*d*2); and (d) wherein:

(i) the upper attachment stop diameter (224*d*) is greater than the minimum receiver central opening diameter (328*d*1) and the upper attachment stop diameter (224*d*) is less than or equal to the maximum receiver central opening diameter (328*d*2);

(ii) the lower attenuated attachment leg diameter (226*d*) is less than or equal to the maximum receiver mouth width (326*w*2) and the lower attenuated attachment leg diameter (226*d*) is greater than the minimum receiver mouth width (326*w*1); and (iii) the lower attachment stop diameter (228*d*) is greater than the minimum receiver central opening diameter (328*d*1) and the maximum receiver central opening diameter (328*d*2).

12. The container carrier system (100) of claim 11, wherein the first resilient jaw (322) and the second resilient jaw (324) are movable between the minimum retaining position and the maximum receiving position upon application of a force of not less than two pounds collectively applied to the first resilient jaw (322) and the second resilient jaw (324).

13. The container carrier system (100) of claim 11, wherein the first resilient jaw (322) and the second resilient jaw (324) are movable between the minimum retaining position and the maximum receiving position upon application of a force of not less than five pounds collectively applied to the first resilient jaw (322) and the second resilient jaw (324).

14. The container carrier system (100) of claim 11, wherein the first resilient jaw (322) and the second resilient jaw (324) are movable between the minimum retaining position and the maximum receiving position upon application of a force of not less than ten pounds collectively applied to the first resilient jaw (322) and the second resilient jaw (324).

15. The container carrier system (100) of claim 11, wherein movement of the first resilient jaw (322) and the second resilient jaw (324) is at least 90 percent elastic.

16. The container carrier system (100) of claim 11, wherein movement of the first resilient jaw (322) and the second resilient jaw (324) is at least 70 percent elastic.

17. The container carrier system (100) of claim 11, wherein movement of the first resilient jaw (322) and the second resilient jaw (324) is at least 50 percent elastic.

18. The container carrier system (100) of claim 11, wherein the handle (200) further comprises a plurality of portions having a plurality of resiliencies.

19. A container carrier system (100) for securing and carrying at least two containers (50) comprising:

(a) a handle (200) having a carrying portion (210) and at least two attachment portions (220), wherein each of the at least two attachment portions (220) include:

(i) an upper leg-stop transition portion (223) joined to an upper attachment stop (224), wherein the upper attachment stop (224) has an upper attachment stop diameter (224*d*); and (ii) a lower attenuated attachment leg (226) joined to the upper attachment stop (224) and terminating in a lower attachment stop (228), wherein the lower attenuated attachment leg (226) has a lower attenuated attachment leg diameter (226*d*) and the lower attachment stop (228) has a lower attachment stop diameter (228*d*);

(iii) an upper connection transition portion (221), comprising a frusto-conical portion, joined to the upper attenuated attachment leg (222);

(b) at least two retainer rings (300) with a single retainer ring (300) secured to a single container (50), wherein each of the at least two retainer rings (300) includes at least one handle receiver (320) for receiving and retaining a single attachment portion (220) of the handle (200), the at least one handle receiver (320) having a first resilient jaw (322) and a second resilient jaw (324) with the first resilient jaw (322) and the second resilient jaw (324) defining a receiver mouth (326) and a receiver central opening (328), wherein the first resilient jaw (322) and the second resilient jaw (324) are movable between a minimum retaining position and a maximum receiving position;

(c) wherein when the first resilient jaw (322) and the second resilient jaw (324) are in the minimum retaining position, the receiver mouth (326) has a minimum receiver mouth width (326*w*1) and the receiver central opening (328) has a minimum receiver central opening diameter (328*d*1), and when the first resilient jaw (322) and the second resilient jaw (324) are in the maximum receiving position, the receiver mouth (326) has a maximum receiver mouth width (326*w*2) and the receiver central opening (328) has a maximum receiver central opening diameter (328*d*2); and (d) wherein:

(i) the upper attachment stop diameter (224*d*) is greater than the minimum receiver central opening diameter (328*d*1) and the upper attachment stop diameter (224*d*) is less than or equal to the maximum receiver central opening diameter (328*d*2);

(ii) the lower attenuated attachment leg diameter (226*d*) is less than or equal to the maximum receiver mouth width (326*w*2) and the lower attenuated attachment leg diameter (226*d*) is greater than the minimum receiver mouth width (326*w*1); and (iii) the lower attachment stop diameter (228*d*) is greater than the minimum receiver central opening diameter (328*d*1) and the maximum receiver central opening diameter (328*d*2).

* * * * *